US011982283B2

(12) United States Patent
Park et al.

(10) Patent No.: US 11,982,283 B2
(45) Date of Patent: May 14, 2024

(54) AIR COMPRESSOR FOR VEHICLE

(71) Applicant: Hanon Systems, Daejeon (KR)

(72) Inventors: Chi Yong Park, Daejeon (KR); Hyun Chil Kim, Daejeon (KR); Gunwoong Park, Daejeon (KR); Min Gyu Park, Daejeon (KR); Yeol Woo Sung, Daejeon (KR); Hyun Sup Yang, Daejeon (KR); Jong Sung Lee, Daejeon (KR); Kyu Sung Choi, Daejeon (KR)

(73) Assignee: Hanon Systems, Daejeon (KR)

( * ) Notice: Subject to any disclaimer, the term of this patent is extended or adjusted under 35 U.S.C. 154(b) by 0 days.

(21) Appl. No.: 18/017,327

(22) PCT Filed: Apr. 1, 2021

(86) PCT No.: PCT/KR2021/004092
§ 371 (c)(1),
(2) Date: Jan. 20, 2023

(87) PCT Pub. No.: WO2022/211158
PCT Pub. Date: Oct. 6, 2022

(65) Prior Publication Data

US 2024/0011498 A1 Jan. 11, 2024

(51) Int. Cl.

| | |
|---|---|
| ***F04D 29/056*** | (2006.01) |
| ***F04D 17/10*** | (2006.01) |
| ***F04D 25/08*** | (2006.01) |
| ***F04D 29/051*** | (2006.01) |
| ***F04D 29/58*** | (2006.01) |

(52) U.S. Cl.
CPC ..... *F04D 25/082* (2013.01); *F04D 17/10* (2013.01); *F04D 29/0513* (2013.01); *F04D 29/056* (2013.01); *F04D 29/5806* (2013.01)

(58) Field of Classification Search
CPC ..... F04D 29/057; F04D 29/0413; F04D 29/0513; F04D 29/0473; F04D 29/582; F04D 29/584; F04D 29/5806; F04D 25/082; F04D 25/06; F04D 17/10
See application file for complete search history.

(56) References Cited

U.S. PATENT DOCUMENTS

| | | | | |
|---|---|---|---|---|
| 5,156,535 | A * | 10/1992 | Budris | F04D 29/2277 416/185 |
| 7,948,105 | B2 * | 5/2011 | Agrawal | F01D 15/10 60/657 |
| 10,724,544 | B2 * | 7/2020 | Graham | F04D 29/284 |
| 10,962,050 | B2 * | 3/2021 | Lee | F04D 29/5806 |

(Continued)

FOREIGN PATENT DOCUMENTS

| | | | | |
|---|---|---|---|---|
| KR | 10-2014-0066105 A | | 5/2014 | |
| KR | 1020170061507 | * | 6/2017 | F04D 29/046 |
| KR | 10-1810430 B1 | | 12/2017 | |

(Continued)

*Primary Examiner* — Justin D Seabe
(74) *Attorney, Agent, or Firm* — Norton Rose Fulbright US LLP; James R. Crawford

(57) ABSTRACT

The present invention relates to a compressor and, more specifically, to an air compressor for a vehicle, which can support a rotor disk and form a cooling flow channel by a first cover and a second cover, and thus can improve cooling efficiency while increasing manufacturability.

16 Claims, 6 Drawing Sheets

(56) References Cited

U.S. PATENT DOCUMENTS

| | | | | |
|---|---|---|---|---|
| 11,639,724 | B2 * | 5/2023 | Kim | F04D 29/28<br>415/175 |
| 2020/0332802 | A1 | 10/2020 | Hwang | |

FOREIGN PATENT DOCUMENTS

| | | | |
|---|---|---|---|
| KR | 10-2020-0056294 | A | 5/2020 |
| KR | 10-2021-0027571 | A | 3/2021 |
| KR | 10-2021-0120275 | A | 10/2021 |

* cited by examiner

AIR COMPRESSOR FOR VEHICLE

CROSS REFERENCE TO RELATED APPLICATIONS

This application is a national phase under 35 U.S.C. § 371 of International Application No. PCT/KR2021/004092 filed on Apr. 1, 2021. The entire contents of these applications are incorporated herein by reference in their entirety.

TECHNICAL FIELD

The present invention relates to a compressor, and more particularly, to an air compressor for a vehicle in which a rotor disk is supported by a first cover and a second cover, and a cooling flow path is formed to improve cooling efficiency, while further increasing manufacturability.

BACKGROUND ART

In general, a fuel cell vehicle refers to a vehicle in which hydrogen and oxygen are supplied to a humidifier and electric energy generated through an electrochemical reaction, which is a reverse reaction of electrolysis of water, is supplied as a driving force of the vehicle, and Korean Patent Registration No. 0962903 discloses a general fuel cell vehicle.

In general, passenger fuel cell vehicles are equipped with a 100 kW fuel cell stack. When the fuel cell stack is operated under pressure, the air supplied to the fuel cell stack is supplied at a high pressure of 1 to 4 bar, and thus, an air compressor with a rotation speed of 100,000 to 200,000 RPM should be used.

A fuel cell vehicle generally includes a fuel cell stack producing electricity, a humidifier increasing humidity of air supplied to the fuel cell stack, a fuel supply unit supplying hydrogen to the fuel cell stack, an air supply unit supplying air including oxygen to the fuel cell stack, and a cooling module cooling the fuel cell stack.

The air supply unit includes an air cleaner filtering foreign substances included in the air, an air compressor compressing the filtered air from the air cleaner to supply compressed air, a cooling device cooling the pressed high temperature air, a humidifier increasing humidity of the air, and a valve adjusting a flow rate.

The aforementioned air compressor compresses air intaken from the outside using a compressor impeller and then sends the same to the fuel cell stack.

Here, the compressor impeller is connected to a rotating shaft receiving power from the driving unit, and in general, the driving unit drives the rotating shaft by electromagnetic induction of a stator and a rotor.

Here, in the air compressor, heat loss occurs due to air resistance in an air bearing due to high-speed rotation of the rotor, and a motor and a bearing which are main heat sources, need to be cooled. Thus, a structure in which the motor and the bearing for rotating the impeller are cooled by utilizing a portion of compressed air produced by the impeller of the air compressor and the compressed air is then introduced into an inlet of the impeller through an internal hole of the rotating shaft of the motor has been proposed.

In this regard, Korean Patent Registration No. 1810430 discloses an air compressor and a fuel cell vehicle in which an internal air flow is circulated using an end of a motor shaft, and the air compressor includes a driving housing having a rotor and a stator therein; a motor shaft having an air exhaust hole through the driving housing; an airfoil bearing coupled to a housing rear end of the driving housing to support a shaft rear end of the motor shaft; and a motor cooling flow path extracting cooling air collected to a motor external camber through an internal space of the driving housing from the impeller chamber from compressed air formed by the impeller and sucking the cooling air to the air exhaust hole to discharge the sucked cooling air from the shaft rear end to the shaft front end.

However, in the air compressor of the related art, as the compressed air passes through a narrow space around an airfoil bearing, a flow rate decreases and as a flow of air is delayed, self-cooling efficiency through the compressed air decreases.

RELATED ART DOCUMENT

Patent Document

Korean Patent Registration No. 10-1810430 (Registered on Dec. 13, 2017)

DISCLOSURE

Technical Problem

An object of the present invention is to provide an air compressor for a vehicle, in which a rotor disk is supported by a first cover and a second cover, and a cooling flow path is formed to improve cooling efficiency, while further increasing manufacturability.

In particular, an object of the present invention is to provide an air compressor for a vehicle, in which a first member and a second member of a second cover are integrally formed to form a chamber portion therein to form a cooling flow path and support a rear of a rotor disk, thereby reducing the number of parts and improving manufacturability.

In addition, an object of the present invention is to provide an air compressor for a vehicle, in which a bearing unit and a rotor may be easily cooled through an outside and inside of the rotor, and a flow of cooling air may be smoothened through a bypass flow path and a hollow expansion portion, thereby increasing cooling performance.

In addition, an object of the present invention is to provide an air compressor for a vehicle, in which a first heat dissipation rib is formed inside the second cover and a second heat dissipation rib is formed outside the second cover and a spacing distance to a control board is sufficiently secured to increase heat dissipation and cooling performance.

Technical Solution

In one general aspect, an air compressor 1000 for a vehicle includes: an impeller 120 compressing introduced air to generate compressed air; a driving unit 200 including a stator 210, a rotor 220 coupled to the impeller 120, and a rotor disk 221 integrally formed at a rear of the rotor 220 to drive the impeller 120; a driving housing 300 in which the driving unit 200 is provided; an impeller housing 110 coupled to a front of the driving housing 300 and having the impeller 120 therein; a first cover 400 coupled to a rear of the driving housing 300 and supporting a front of the rotor disk 221; and a second cover 500 coupled to the first cover 400 to support the other side of the rotor disk 221.

In addition, the air compressor 1000 for a vehicle may include a bearing unit 600 including a first airfoil bearing 611 and a second airfoil bearing 612 respectively provided at a front and rear of the rotor disk 221.

Also, the air compressor 1000 for a vehicle may include a cooling flow path for cooling the bearing unit 600 and the rotor 220 by introducing the compressed air discharged from the impeller 120 into the bearing unit 600.

In addition, the cooling flow path may include a first cooling flow path P1 in which a portion of the air compressed by the impeller 120 performs cooling, while moving from the front to the rear along an outer side of the rotor 220 to perform cooling; and a second cooling flow path P2 in which the air moved from the first cooling flow path P1 performs cooling, while moving toward the impeller 120 along a hollow shaft portion 222 in which a center of the rotor 220 is axially hollow, and wherein the second cover 500 includes a hollow portion 512 in which a central predetermined region is hollow so that the first cooling flow path P1 and the second cooling flow path P2 communicate with each other.

In addition, the cooling flow path may include a bypass flow path P3 through which the compressed air bypasses at least a portion of the bearing unit 600, and in this case, the bypass flow path P3 is formed by a first hollow hole 401 penetrating through the first cover 400.

In addition, the bypass flow path P3 may be formed by a second hollow hole 515 penetrating through the second cover 500.

In addition, in the second cover 500, the second hollow hole 515 may be inclined to be closer to a central direction of the rotor 220 in a direction from the front to the rear.

In addition, the second cover 500 may have a plurality of second hollow holes 515 formed along the circumference.

In addition, the second cover 500 may include a chamber portion 501 forming a certain space therein and communicating with the hollow portion 512 and the bypass flow path P3.

In addition, the second cover 500 may include: a first member 510 including a body portion 511 forming a coupling surface with the first cover 400, a support portion 513 protruding from one side surface of the body portion 511 and supporting the rotor disk 221, and a chamber forming portion 514 protruding from the other side surface of the body portion 511 to form a chamber portion 501 therein, and a plate-shaped second member 520 coupled to the chamber forming portion 514 of the first member 510, the first member 510 and the second member 520 being integrally bonded.

In addition, the second cover 500 may have a plurality of first heat dissipation ribs 530 having a certain region protruding from an inner surface of the chamber forming portion 514 to the inside of the chamber portion 501.

In addition, the second cover 500 may have a plurality of second heat dissipation ribs 540 protruding from the other side surface of the body portion 511 and an outer surface of the chamber forming portion 514.

In addition, in the air compressor 1000 for a vehicle, an inner diameter D512 of the hollow portion of the second cover 500 may be formed larger than an inner diameter D400 of the first cover.

In addition, a certain region of a rear end of the rotor 220 may be inserted into the hollow portion 512 region of the second cover 500.

In addition, the rotor 220 may have a step portion 223 whose outer diameter is narrowed toward the rear side in a region inserted into the hollow portion 512.

In addition, the hollow shaft portion 222 may include an expanded introduction portion 222*a* having a larger inner diameter than the rest of the hollow portion in a certain rear portion communicating with the chamber portion 501.

In addition, the air compressor 1000 for a vehicle may include a controller 700 including a control board 710, and the control board 710 is fixed to the driving housing 300 at a certain distance from the outside of the second cover 500 to the rear side.

In addition, a spacing distance D710 between the second cover 500 and the control board 710 may be 4 mm or more.

In addition, the air compressor 1000 for a vehicle may include a front journal bearing 621 and a rear journal bearing 622 disposed on both ends of an outer circumferential surface of the rotor 220 and supporting the rotor 220 to smoothly rotate inside the driving housing 300.

In addition, in the second cover 500, the second hollow hole 515 may be formed parallel to a central axis of the rotor 220.

In addition, a distance C2 between a rear end of the rotor 220 and the second member 520 may be larger than an inner diameter C1 of the hollow shaft portion 222.

Advantageous Effects

Accordingly, in the air compressor for a vehicle, a rotor disk is supported by a first cover and a second cover, and a cooling flow path is formed to improve cooling efficiency, while further increasing manufacturability.

In particular, in the air compressor for a vehicle, a first member and a second member of a second cover are integrally formed to form a chamber portion therein to form a cooling flow path and support a rear of a rotor disk, thereby reducing the number of parts and improving manufacturability.

In addition, in the air compressor for a vehicle, a bearing unit and a rotor may be easily cooled through an outside and inside of the rotor, and a flow of cooling air may be smoothened through a bypass flow path and a hollow expansion portion, thereby increasing cooling performance.

In addition, in the air compressor for a vehicle, a first heat dissipation rib is formed inside the second cover and a second heat dissipation rib is formed outside the second cover, and a spacing distance to a control board is sufficiently secured to increase heat dissipation and cooling performance.

BEST MODE

Hereinafter, an air compressor 1000 for a vehicle of the present invention having the characteristics described above will be described in detail with reference to the accompanying drawings.

Figure 1:
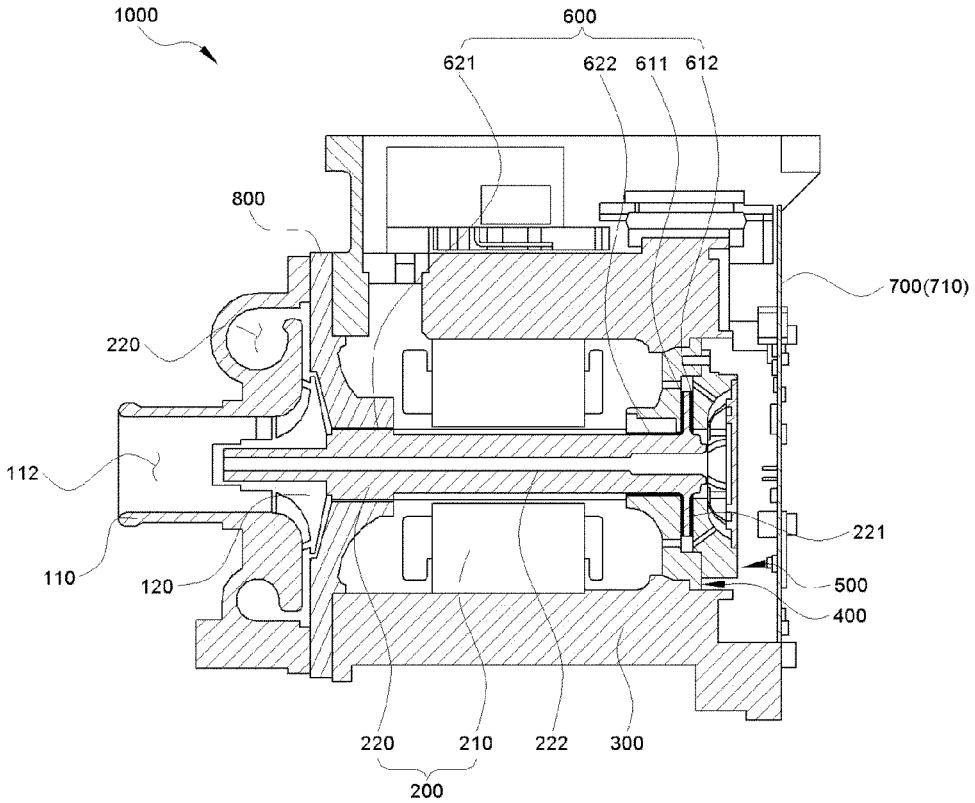
FIGS. 1 and 2 are a cross-sectional view and a partially enlarged view of an air compressor for a vehicle according to the present invention.
Figure 2:
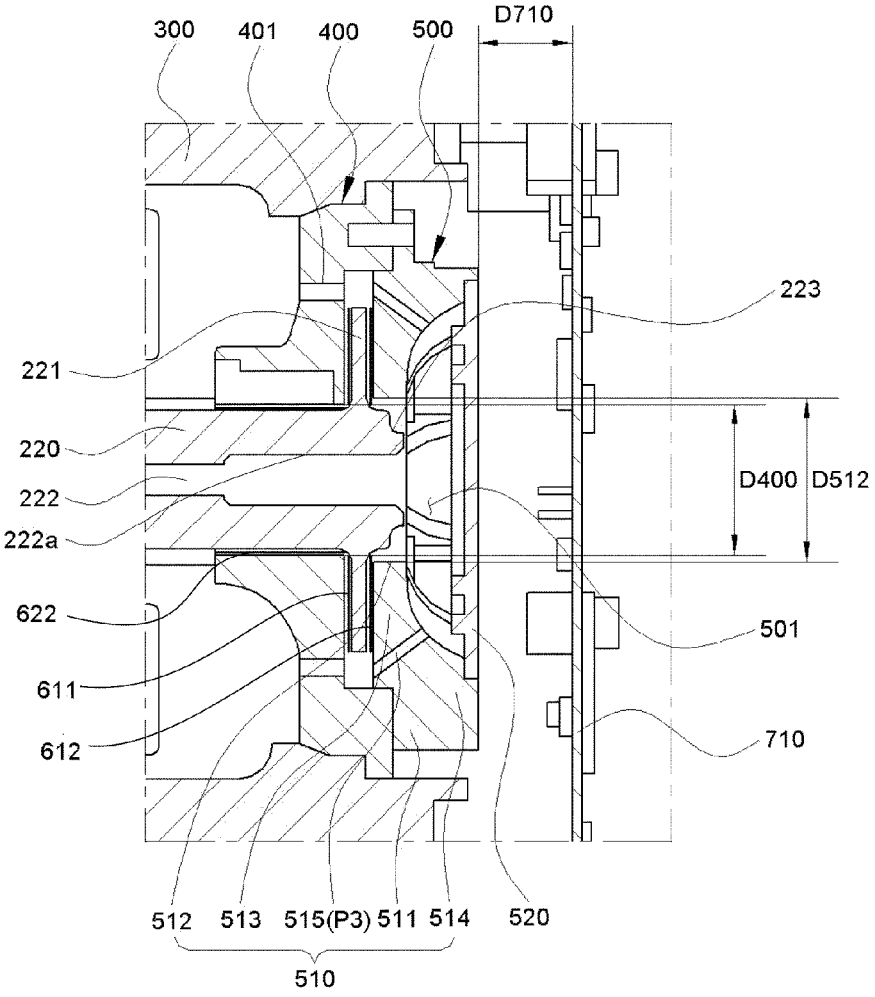
Figure 3:
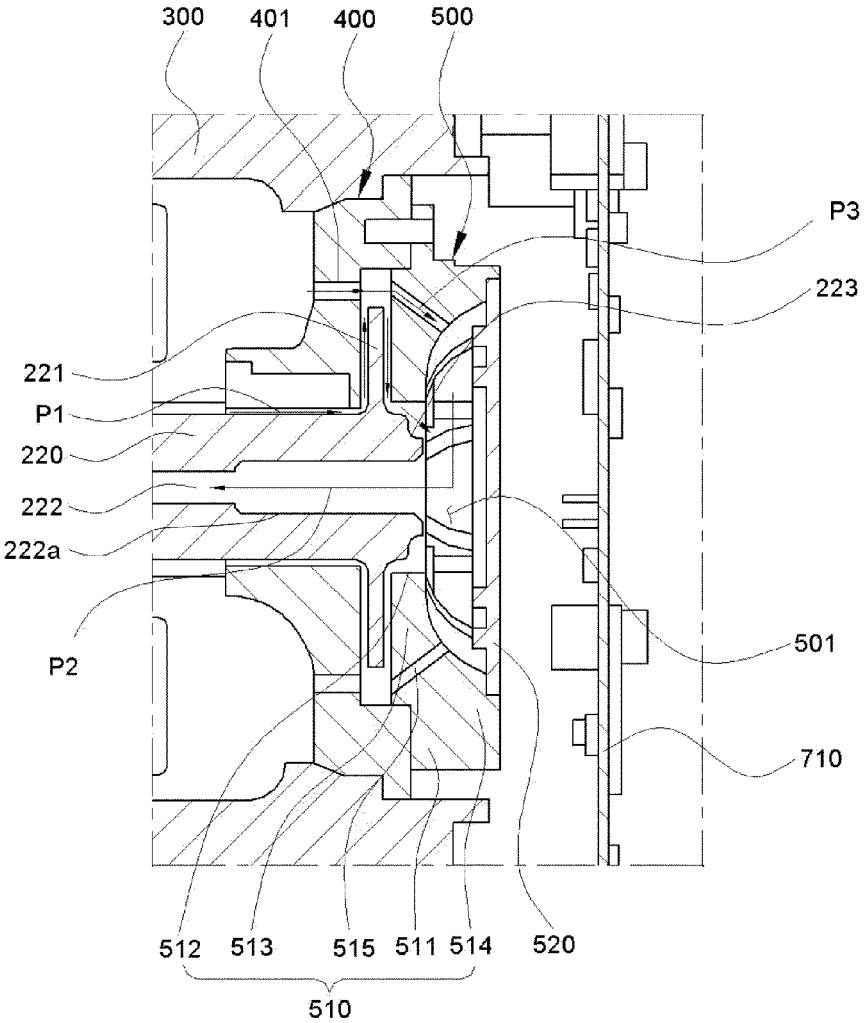
FIG. 3 is an enlarged view showing a flow of a cooling flow path of an air compressor for a vehicle according to the present invention.
Figure 4:
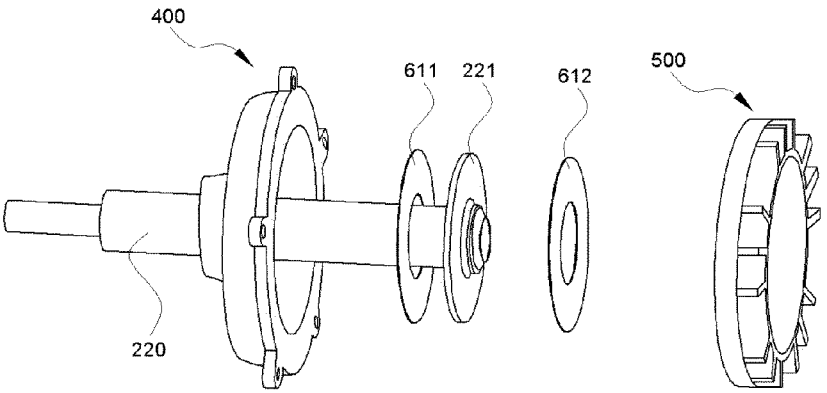
FIG. 4 is a partially exploded perspective view of an air compressor for a vehicle according to the present invention.
Figure 5:
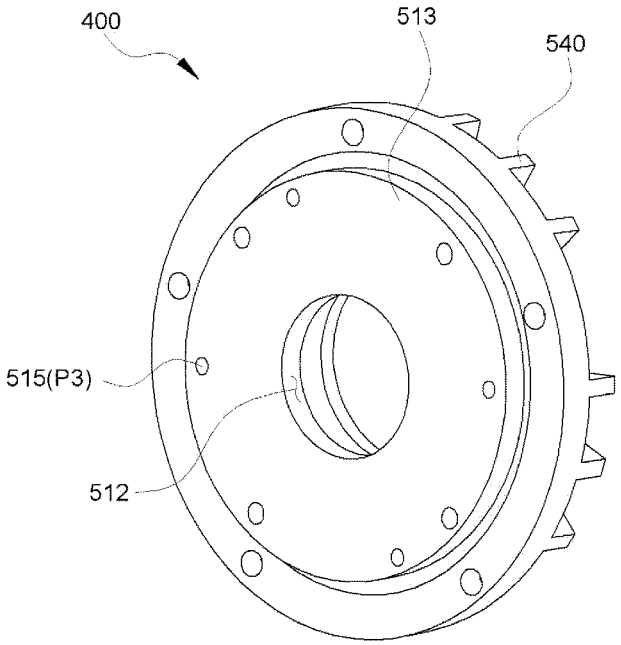
FIG. 5 is a perspective view of a second cover of an air compressor for a vehicle according to the present invention.
Figure 6:
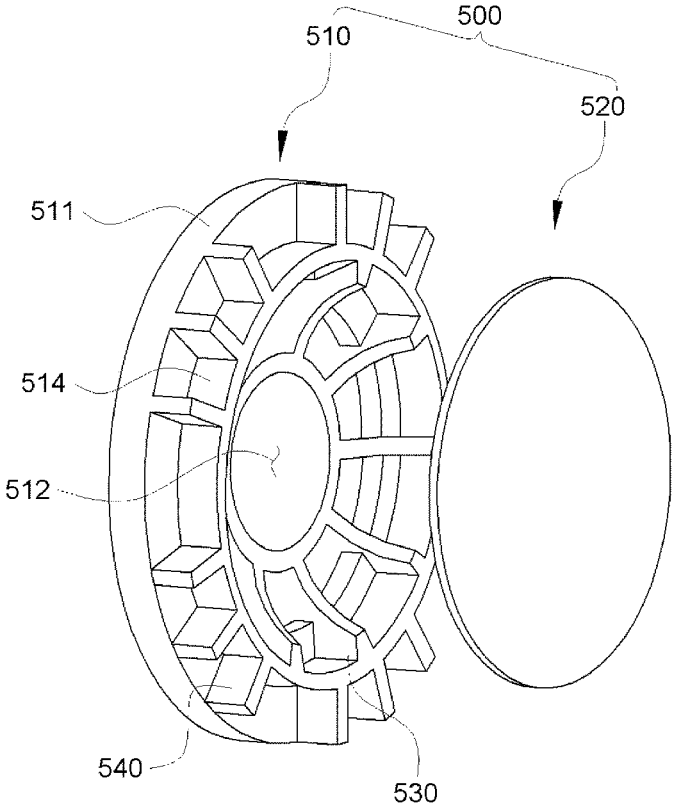
FIG. 6 is an exploded perspective view of a second cover of an air compressor for a vehicle according to the present invention.

FIGS. 1 and 2 are a cross-sectional view and a partially enlarged view of an air compressor 1000 for a vehicle according to the present invention, FIG. 3 is an enlarged view showing a flow of a cooling flow path of the air compressor 1000 for a vehicle according to the present invention, FIG. 4 is a partially exploded perspective view of the air compressor 1000 for a vehicle according to the present invention, FIG. 5 is a perspective view of a second cover 500 of the air compressor 1000 for a vehicle according to the present invention, and FIG. 6 is an exploded perspective view of the second cover 500 of the air compressor 1000 for a vehicle according to the present invention.

The air compressor 1000 for a vehicle according to the present invention includes an impeller 120, a driving unit 200, a driving housing 300, an impeller housing 110, a first cover 400, and the second cover 500.

The impeller 120 is a portion that compresses introduced air to generate compressed air, and is coupled to an inside of the impeller housing 110. The impeller housing 110 includes a front inlet 111 through which compression target air is introduced and a front outlet 112 connected in the form of a volute in which an internal space is gradually narrowed from the front inlet 111 and allowing compressed air to be discharged therethrough. At this time, the impeller 120 compresses the introduced air, while rotating upon receiving a driving force from the rotor 220 of the driving unit 200 to be described later.

The driving unit 200 includes a stator 210, a rotor 220, and a rotor disk 221. The driving unit 200 is provided in the driving housing 300, the stator 210 includes a plate and a coil, and is mounted and fixed inside the driving housing 300, and the rotor 220 rotates therein.

The rotor 220 and the rotor disk 221 are integrally formed, and in the present invention, the rotor disk 221 is provided in the rear (in a rightward direction in FIGS. 1 to 6, the front in the present invention is defined as a side on which the impeller 120 is provided, and the rear is defined to be opposite to the front in a length direction of the rotor 220).

The rotor 220 has a hollow shaft portion 222 having a hollow center in an axial direction to form a second cooling flow path P2.

The hollow shaft portion 222 includes an expanded introduction portion 222*a* in which a hollow inner diameter of a certain region on the rear side, which is the side in which air is introduced, is larger than that of the remaining region, so that the air flow of the cooling flow path to be described later is smoothly made.

When external power is supplied, the rotor 220 generates a rotational force by electromagnetic interaction with the stator 210, and the impeller 120 rotates by this force and air is compressed.

At this time, the air compressor 1000 for a vehicle of the present invention includes a bearing unit 600 to easily support rotation of the rotor 220 and the rotor disk 221, and the bearing unit 600 may include a first airfoil bearing 611 and a second airfoil bearing 612 provided at the front and rear of the rotor disk 221, respectively, and a front journal bearing 621 and a rear journal bearing 622 that support the rotor 220 to smoothly rotate inside the driving housing 300.

The first cover 400 and the second cover 500 are sequentially coupled to the rear of the driving housing 300 to support the rotor disk 221 and form a cooling flow path.

First, the first cover 400 is coupled to the rear of the driving housing 300 and supports the front of the rotor disk 221. The first cover 400 is hollowed so that the rotor 220 (and the rear journal bearing 622) is inserted into the center. In particular, when the bearing unit 600 is mounted, the first cover 400 supports the rear journal bearing 622 supporting the first airfoil bearing 611 and the rotor 220 at the front of the rotor disk 221.

The second cover 500 is coupled to the first cover 400 to support the rear of the rotor disk 221. In particular, when the bearing unit 600 is mounted, the second cover 500 supports the second airfoil bearing 612 at the rear of the rotor disk 221.

The air compressor 1000 for a vehicle of the present invention includes a cooling flow path for cooling the bearing unit 600 and the rotor 220 by introducing compressed air discharged from the impeller 120 into the bearing unit 600, and the cooling flow path will be described later.

In the second cover 500, the first member 510 and the second member 520 are integrally formed to form a chamber portion 501 that is a predetermined space in which air flows.

The first member 510 is a portion coupled to the first cover 400 and forms a front side of the second cover 500. The first member 510 includes a body portion 511 forming a coupling surface with the first cover 400, a support portion 513 protruding from one side surface of the body portion 511 to support the rotor disk 221, and a chamber forming portion 514 having a circumference protruding from the other side surface of the body portion 511 to form a chamber portion 501 therein.

The support portion 513 is a portion protruding toward the front side, which is one side surface of the body portion 511, to support the rotor disk 221 and the second airfoil bearing 612.

The chamber forming portion 514 is a portion having a circumference protruding toward the rear side, which is the other side surface of the body portion 511, to form the chamber portion 501 therein.

The first member 510 of the second cover 500 has a hollow portion 512 in which a predetermined central region is hollowed, and a predetermined rear region of the rotor 220 is inserted into the hollow portion 512 region. In addition, a plurality of second hollow holes 515 forming a bypass flow path P3 is formed around the hollow portion 512. The second hollow hole 515 is formed to be inclined toward the center of the rotor 220 from the front to the rear.

At this time, a hollow inner diameter D512 of the second cover 500 is formed larger than an inner diameter D400 of the first cover, and a step portion 223 having a narrowing outer diameter is formed at an end portion of the rotor 220 inserted into the hollow portion 512 of the second cover 500 so that air may easily move from the front to the rear in which the chamber portion 501 is formed (refer to FIG. 2).

In addition, the second cover 500 may have a plurality of first heat dissipation ribs 530 protruding from the inner surface of the chamber forming portion 514 to the inside of the chamber unit 501 in a certain region. A plurality of the first heat dissipation ribs 530 are arranged to be spaced apart from each other in a rear circumferential direction, and are formed to have a curved surface that is gentle from the center in a circumferential direction on an inner surface of the chamber forming portion 514 at the rear of the body portion 511.

In addition, the second cover 500 has a plurality of second heat dissipation ribs 540 protruding in a radial direction from the other side surface of the support portion 513 and an outer surface of the chamber forming portion 514.

The second cover 500 includes a first heat dissipation rib 530 inside and a second heat dissipation rib 540 outside, so that air is smoothly cooled and then supplied to the hollow shaft portion 222 to improve cooling performance of the rotor 220.

In addition, the air compressor 1000 for a vehicle of the present invention may include a controller 700 including a control board 710, and the controller 700 is spaced apart from the rear of the second cover 500 by a certain distance to minimize heat exchange between heat generated by the control board 710 and air inside the chamber portion 501, and the spacing distance is preferably 4 mm or more.

The second member 520 has a plate shape coupled to the chamber forming portion 514 of the first member 510 and is integrally formed with the first member 510.

Reference numeral 800, not described in FIG. 1, denotes a diffuser 800, which is provided between the impeller housing 110 and the driving housing 300 to support the rear of the impeller 120 and supports the front journal bearing 621.

A cooling flow path (air flow) for cooling the air compressor 1000 for a vehicle of the present invention having the configuration as described above will be described.

The cooling flow path is configured to cool the driving unit 200 and the bearing unit 600 inside the driving housing 300 using a portion of the compressed air compressed by the impeller 120, and includes a first cooling flow path P1 and a second cooling flow path P2.

The cooling flow path is shown in FIG. 3. FIG. 3 shows an air flow with the arrows using the same drawing as FIG. 2, and a configuration of the bearing unit 600 is not shown in order to clearly indicate the flow of the arrows.

The first cooling flow path P1 is configured to cool a portion of the air compressed by the impeller 120, while moving along the outside of the rotor 220 from the front to the rear, and cools, together with the outside of the rotor 220, the front journal bearing 621, the rear journal bearing 622, the first airfoil bearing 611, and the second airfoil bearing 612.

The second cooling flow path P2 cools air moved from the first cooling flow path P1, while moving toward the impeller 120 along the hollow shaft portion 222 of the rotor 220. That is, the air inside the second cooling flow path P2 moves from the rear to the front.

The first cooling flow path P1 and the second cooling flow path P2 communicate with each other through the chamber portion 501, and air passing through the first cooling flow path P1 is introduced into the chamber portion 501 through the hollow portion 512 of the second cover 500 and moves to the second cooling flow path P2.

In addition, the air compressor 1000 for a vehicle of the present invention may include the bypass flow path P3 through which the compressed air bypasses at least a partial region of the bearing unit 600.

The bypass flow path P3 may be formed by a first hollow hole 401 passing through the first cover 400, and may also be formed by a second hollow hole 515 penetrating through the second cover 500.

The air compressor 1000 for a vehicle of the present invention includes one and both of the first hollow hole 401 and the second hollow hole 515 formed therein.

The first hollow hole 401 forms a space that air inside the driving housing 300 bypasses, without passing through the rear journal bearing 622, and the second hollow hole 515 forms a space that air moved through the first hollow hole 401 or air passing through the rear journal bearing 622 and the first airfoil bearing 611 of the first cooling flow path P1 bypasses, without passing through the second airfoil bearing 612.

Through this, the air compressor 1000 for a vehicle of the present invention forms the bypass flow path P3, while cooling the bearing unit 600 by the first cooling flow path P1 to lower a temperature of the air passing through the hollow shaft portion 222, thereby sufficiently securing the cooling performance of the rotor 220.

That is, the air compressor 1000 for a vehicle of the present invention may support the rotor disk 221 using only the configuration of the first cover 400 and the second cover 500 and may form a cooling flow path, thereby improving cooling efficiency, while improving manufacturability.

Figure 7:
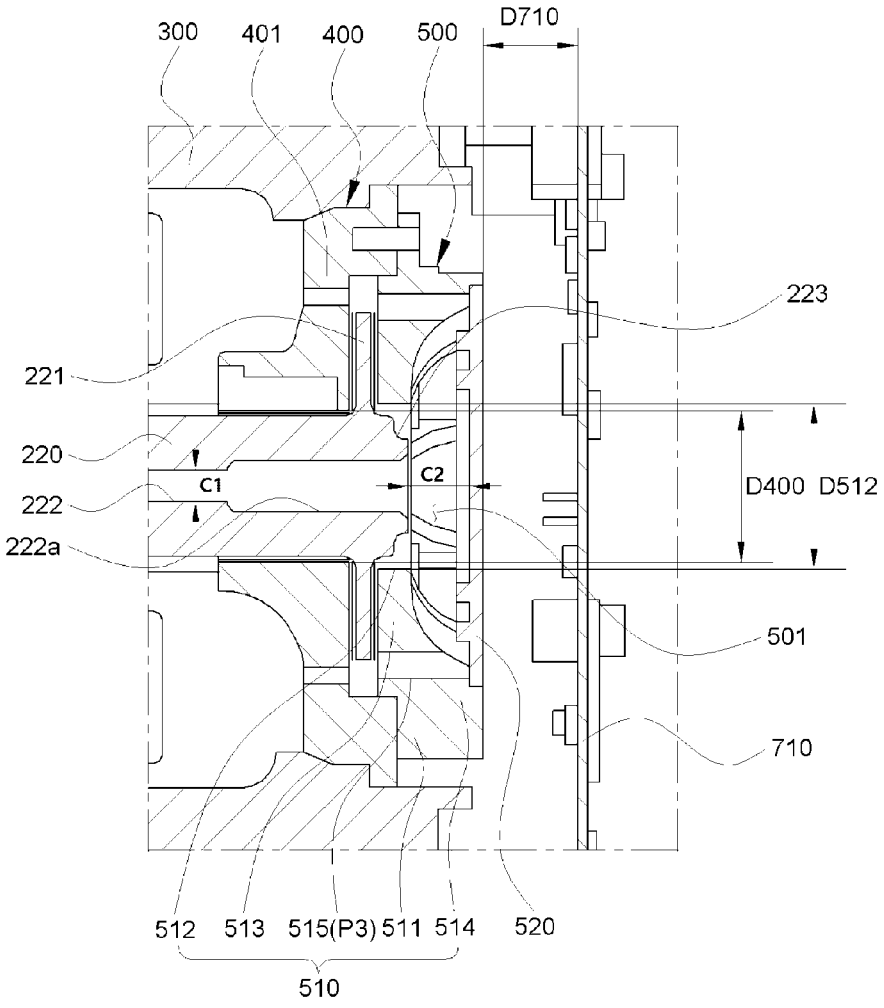
FIG. 7 is a partial cross-sectional view showing another embodiment of an air compressor for a vehicle according to the present invention.

FIG. 7 is a partial cross-sectional view showing another embodiment of an air compressor for a vehicle according to the present invention.

Referring to FIG. 7, a second hollow hole 515 of the second cover 500 may be formed in a direction parallel to the central axis of the rotor 220, and accordingly, the hole may be easily worked, compared to that in which the second hollow hole 515 is formed to be inclined with respect to a central axis of the rotor 220.

In addition, a distance C2 between a rear end of the rotor 220 and the surfaces of the second member 520 facing each other may be greater than an inner diameter C1 of the hollow shaft portion 222. This is because, if C2 is smaller than C1, a flow introduced into the hollow shaft portion 222 may not be smooth and a cooling flow rate transmitted to the rear surface of the impeller may be reduced, which is disadvantageous in cooling the compressor and a thrust bearing. Therefore, a minimum length of C2 is configured to be longer than the length of C1, thereby increasing the space of the chamber portion 501 and securing the flow path of the introduction portion at the same time, thereby increasing the amount of cooling air to increase the cooling effect inside the compressor.

The present invention is not limited to the above-mentioned exemplary embodiments but may be variously applied, and may be variously modified by those skilled in the art to which the present invention pertains without departing from the gist of the present invention claimed in the claims.

DETAILED DESCRIPTION OF MAIN ELEMENTS

1000: air compressor for vehicle
110: impeller housing 111: front inlet 112: front outlet
120: impeller 200: driving unit 210: stator
220: rotor 221: rotor disk 222: hollow shaft portion
222*a*: expanded introduction portion 223: step portion 300: driving housing
400: first cover 401: first hollow hole D400: inner diameter of first cover
500: second cover 501: chamber portion 510: first member
511: body portion 512: hollow portion D512: inner diameter of hollow portion
513: support portion 514: chamber forming portion 515: second hollow hole
520: second member 530: first heat dissipation rib 540: second heat dissipation rib
600: bearing unit 611: first airfoil bearing 612: second airfoil bearing
621: front journal bearing 622: rear journal bearing
700: controller 710: control board D710: spacing distance
800: diffuser P1: first cooling flow path
P2: second cooling flow path P3: bypass flow path
C1: inner diameter of hollow shaft portion C2: distance between rear end of rotor and second member

The invention claimed is:

1. An air compressor for a vehicle, the air compressor comprising:

an impeller compressing introduced air to generate compressed air;

a driving unit including a stator, a rotor coupled to the impeller, and a rotor disk integrally formed at a rear of the rotor to drive the impeller;

a driving housing in which the driving unit is provided;

an impeller housing coupled to a front of the driving housing and having the impeller therein;

a first cover coupled to a rear of the driving housing and supporting a front of the rotor disk; and a second cover coupled to the first cover to support the other side of the rotor disk, wherein the air compressor for a vehicle includes a bearing unit including a first airfoil bearing and a second airfoil bearing respectively provided at a front and rear of the rotor disk, wherein the air compressor for a vehicle includes a cooling flow path for cooling the bearing unit and the rotor by introducing the compressed air discharged from the impeller into the bearing unit, wherein the cooling flow path includes:

a first cooling flow path in which a portion of the air compressed by the impeller performs cooling, while moving from the front to the rear along an outer side of the rotor to perform cooling; and a second cooling flow path in which the air moved from the first cooling flow path performs cooling, while moving toward the impeller along a hollow shaft portion in which a center of the rotor is axially hollow, and wherein the second cover includes a hollow portion in which a central predetermined region is hollow so that the first cooling flow path and the second cooling flow path communicate with each other, wherein the cooling flow path includes a bypass flow path through which the compressed air bypasses at least a portion of the bearing unit, wherein the bypass flow path is formed by a first hollow hole penetrating through the first cover, wherein the bypass flow path is formed by a second hollow hole penetrating through the second cover, and wherein the first hollow hole forms a space that air inside the driving housing bypasses, without passing through the rear journal bearing, and the second hollow hole forms a space that air moved through the first hollow hole or air passing through the rear journal bearing and the first airfoil bearing of the first cooling flow path bypasses, without passing through the second airfoil bearing.

2. The air compressor of claim 1, wherein, in the second cover, the second hollow hole is inclined to be closer to a central direction of the rotor in a direction from the front to the rear.

3. The air compressor of claim 2, wherein the second cover has a plurality of second hollow holes formed along the circumference.

4. The air compressor of claim 1, wherein the second cover includes a chamber portion forming a certain space therein and communicating with the hollow portion and the bypass flow path.

5. The air compressor of claim 4, wherein the second cover includes:

a first member including a body portion forming a coupling surface with the first cover, a support portion protruding from one side surface of the body portion and supporting the rotor disk, and a chamber forming portion protruding from the other side surface of the body portion to form the chamber portion therein, and a plate-shaped second member coupled to the chamber forming portion of the first member, the first member and the second member being integrally bonded.

6. The air compressor of claim 5, wherein the second cover has a plurality of first heat dissipation ribs having a certain region protruding from an inner surface of the chamber forming portion to the inside of the chamber portion.

7. The air compressor of claim 6, wherein the second cover has a plurality of second heat dissipation ribs protruding from the other side surface of the body portion and an outer surface of the chamber forming portion.

8. The air compressor of claim 5, wherein a distance between an end of the rotor and the second member is larger than an inner diameter of the hollow shaft portion.

9. The air compressor of claim 1, wherein, in the air compressor for the vehicle, an inner diameter of the hollow portion of the second cover is formed larger than an inner diameter of the first cover.

10. The air compressor of claim 9, wherein a region of a rear end of the rotor is inserted into the hollow portion region of the second cover.

11. The air compressor of claim 10, wherein the rotor has a step portion whose outer diameter is narrowed toward the rear side in a region inserted into the hollow portion.

12. The air compressor of claim 11, wherein the hollow shaft portion includes an expanded introduction portion having a larger inner diameter than the rest of the hollow portion 501.

13. The air compressor of claim 1, wherein the air compressor for the vehicle includes a controller including a control board, and the control board is fixed to the driving housing at a certain distance from the outside of the second cover to the rear side.

14. The air compressor of claim 13, wherein a spacing distance between the second cover and the control board is 4 mm or more.

15. The air compressor of claim 14, wherein the air compressor for the vehicle includes a front journal bearing and a rear journal bearing disposed on both ends of an outer circumferential surface of the rotor and supporting the rotor to smoothly rotate inside the driving housing.

16. The air compressor of claim 1, wherein, in the second cover, the second hollow hole is formed parallel to a central axis of the rotor.

* * * * *